United States Patent [19]

Ford, Jr.

[11] Patent Number: 4,531,660

[45] Date of Patent: Jul. 30, 1985

[54] FOAM DISPENSING DEVICE

[75] Inventor: George W. Ford, Jr., Salt Lake City, Utah

[73] Assignee: Hershel Earl Wright, Decatur, Ill.

[21] Appl. No.: 614,704

[22] Filed: May 29, 1984

Related U.S. Application Data

[63] Continuation of Ser. No. 330,254, Dec. 14, 1981, abandoned.

[51] Int. Cl.[3] ..... B65D 37/00

[52] U.S. Cl. ..... 222/209; 222/373; 222/401; 222/207

[58] Field of Search ..... 222/209, 211, 401, 207, 222/189, 190, 212, 213, 373, 206

[56] References Cited

U.S. PATENT DOCUMENTS

| | | | |
|---|---|---|---|
| 296,435 | 4/1884 | Murdock | 222/209 |
| 3,323,689 | 6/1967 | Elmore | 222/209 X |
| 3,422,993 | 1/1969 | Boehm et al. | 222/190 |
| 3,709,437 | 1/1973 | Wright | 222/190 X |
| 4,027,789 | 6/1977 | Dickey | 222/190 |
| 4,044,923 | 8/1977 | Gardner | 222/190 |
| 4,184,615 | 1/1980 | Wright | 222/190 |

*Primary Examiner*—Robert B. Reeves
*Assistant Examiner*—Russell D. Stormer
*Attorney, Agent, or Firm*—Cohn, Powell & Hind

[57] ABSTRACT

This foam dispensing device includes an outer container for holding foamable liquid, and a foam producing unit mounted in the discharge port of the outer container. The foam producing unit includes an inner container of substantial smaller cross section than the outer container, and a closure cap having a pressurized air inlet and foam outlet. A one-way valve is provided between the inner and outer containers which opens to replenish the foamable liquid supply in the inner container but remains closed during the foam forming process.

4 Claims, 4 Drawing Figures

FOAM DISPENSING DEVICE

This is a continuation of application Ser. No. 330,254, filed Dec. 14, 1981, now abandoned.

BACKGROUND OF THE INVENTION

This invention relates generally to foam dispensing devices and particularly to a device having an outer container and a relatively small auxiliary inner container filled from the outer container and requiring a smaller air supply to operate.

Several non-aerosol foaming devices have been developed in recent years which are essentially hand-held squeeze bottles of relatively small capacity. Such squeeze bottles, as exemplified by U.S. Pat. No. 3,709,437 and U.S. Pat. No. 3,937,364 work well for their intended purpose but are not readily adapted for use with large containers which are considerably more economical to use. The reason for this is that the control of pressure and foamable liquid capacity is difficult because of the relatively small optimum size of the foam producing components required to produce superior foam quality.

This foam dispenser device provides a means of utilizing foam producing systems, currently limited to use with smaller containers, for use with containers of much greater capacity.

SUMMARY OF THE INVENTION

This foam dispensing device provides a means of using large capacity containers for the production of superior foam by utilizing an inner auxiliary container which is replenished with a foamable liquid supply from the larger container.

The foam dispenser includes an outer container for holding foamable liquid having a discharge port, and a foam producing unit mounted to the container and separating the area adjacent the discharge port and the interior of the container. The foam producing unit includes an inner container disposed within the outer container and having an opening communicating with said outer container; a closure for the inner container having pressurized air inlet means and foam outlet means; foam producing means communicating with the foam outlet means and including an inwardly extending conduit having an opening communicating with the interior of the inner container; and valve means for the inner container opening, said valve means selectively closing said opening when air pressure within the inner container is increased to supply foamable liquid from the inner container to the conduit of the foam producing means, and said valve means selectively opening said opening when air pressure within the inner container is decreased to permit flow of foamable liquid from the outer container to the inner container.

It is an aspect of this invention to provide a valve means which includes a flexible element selectively opening and closing the inner container opening.

It is another aspect of this invention to provide pump means to supply pressurized air to the air inlet means.

It is still another aspect of this invention to provide a closure which includes a cap having a passage extending therethrough providing the air inlet means, and to provide an inner container formed from a tubular member integrally formed with the closure cap.

It is still another aspect of this invention to provide that the integrally formed inner container and closure cap are received by the outer container discharge port.

DESCRIPTION OF THE PREFERRED EMBODIMENT

Figure 1:
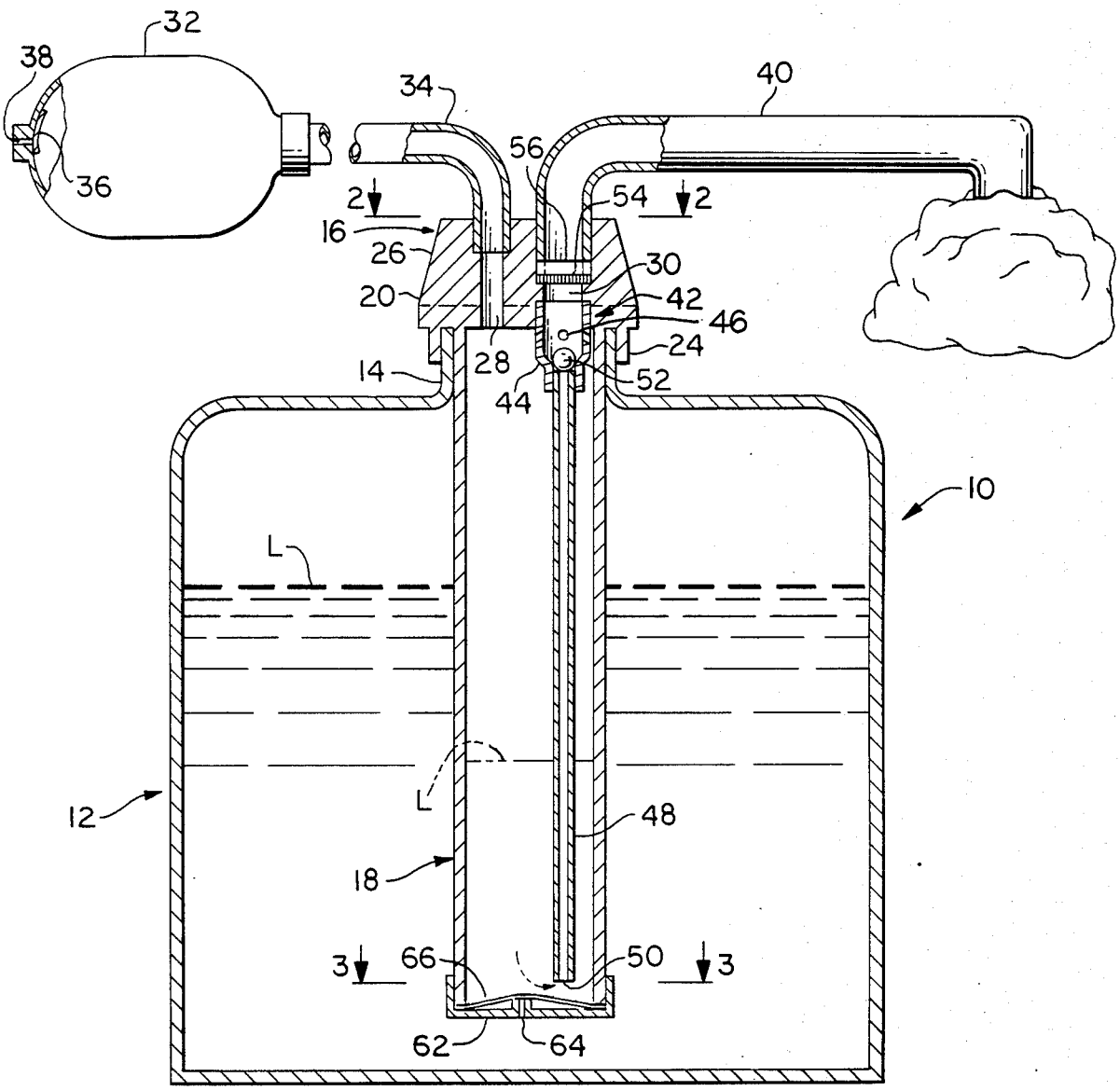
FIG. 1 is a longitudinal sectional view of the device.
Figure 2:
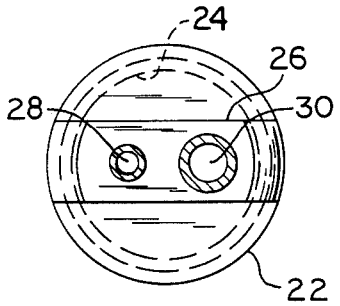
FIG. 2 is a sectional plan view taken on line 2—2 of FIG. 1.
Figure 3:
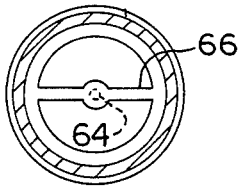
FIG. 3 is a sectional plan view taken on line 3—3 of FIG. 1.

Referring now by reference numerals to the drawing and first to FIG. 1 it will be understood that the foam dispensing device, generally indicated by numeral 10, includes an outer container 12 having a neck portion 14 defining a discharge port. The device also includes a foam producing unit 16 mounted within the neck of the container 12 and separating the area adjacent the discharge port and the interior of the container.

The container 12 provides a reservoir for foamable liquid generally indicated by L and may be formed from any suitable rigid or non-rigid material such as metal or plastic.

The foam producing unit 16 includes a tubular member 18, of rigid plastic or the like providing an auxiliary inner container disposed within the outer container 12 and a closure cap 20.

The closure cap 20 includes a base portion 22, a depending annular ring 24 and an outwardly projecting portion 26. The closure cap 20 also includes a passage 28 extending therethrough and providing a pressurized air inlet means into the tubular member 18 and a passage 30 extending therethrough and providing a foam outlet means from the tubular member 18.

In the embodiment shown, pressurized air is supplied to the air inlet passage 28, as by a bulb 32 connected to the passage 28 by a connecting tubular member 34. As shown in FIG. 1, the bulb 32 includes a one-way valve such as provided by the diaphragm 36 covering the bulb air inlet passage 38. However, it will be understood that other pressurized air producing means, such as a foot pump, could be used in place of a bulb.

The foam inlet passage 30 is fitted at its upper end with a tubular member 40 which, in effect, provides an extension to said foam outlet passage. As shown, the passage 30 also provides a mounting for a foam producing means generally indicated by numeral 42, which communicates with the tubular member 40.

The foam producing means 42, in the embodiment shown, is similar to that disclosed in U.S. Pat. No. 3,709,437 in that it includes a downwardly depending hollow element 44 having air passages 46 disposed thereabout, and providing a foam producing mixing chamber. An elongate tubular member 48, providing an inwardly extending conduit means, is attached to the hollow element 44 and communicates with said element at its upper end. The tubular member 48 also includes an opening 50 at its lower end. The air passages 46 provide for the introduction of air into the mixing chamber formed by member 44 at the same time that foamable liquid is introduced into said mixing chamber by the tubular member 48. The cross section of the air passage 46 is such that free flow of air therethrough is restricted causing air pressure acting upon the upper surface of the foamable liquid to force the foamable liquid upwardly through the tubular member 48 and into the mixing chamber. Simultaneous introduction of air and foamable liquid affects the intermixing of liquid and air to produce foam. In the embodiment shown, a ball check valve 52 is provided for the mixing chamber which seats with a reduced portion of the hollow element 44 to prevent the return of foam into the tubular member 48. Passage 30 is configurated to provide a seat for a beam homogenizing overlay element 54 which is held in place by means of a retainer ring 56. It will be understood that other foam producing means could be used if desired such as the disclosed in U.S. Pat. No. 3,937,364.

Figure 4:
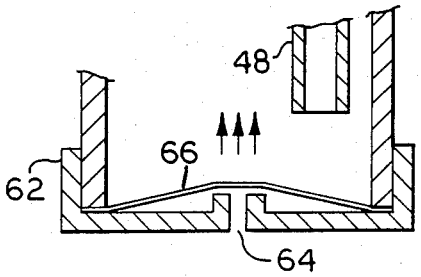
FIG. 4 is an enlarged view illustrating the valve action.

The tubular member 18, in the embodiment shown, is integrally formed with the closure cap 20. An inner cap 62 providing an inner end wall is also provided, said cap 62 having an end opening 64 therein communicating with the outer container 12. One-way valve means, in the form of a flexible element 66 of rubber or the like, is provided for the opening 64 and is held in place by the end cap 62. The valve means is selectively closed, as shown in FIG. 1, when air pressure within the inner container 60 is increased by applying pressure to the bulb 32, so that the flexible element 66 is urged against the opening 64 and air pressure forces liquid L down the tubular member 18 to L', with the result that foamable liquid L is supplied, by way of the tubular member 48, to the foam producing means 42. When the air pressure is relieved, the valve means is selectively opened, as shown in FIG. 4, by lifting flexible element 66 away from the opening 64 to permit flow of the foamable liquid from the outer container 12 to the inner container 18. Of course, if desired, a ball valve or other form of one-way valve could be used in lieu of the flexible element 66.

When the foam producing unit 16 is initially inserted into the outer container 12 containing foamable liquid L, the flexible element 66 is opened to admit liquid into the inner container by virtue of the pressure differential resulting from the difference in liquid levels between the inner and outer containers. When the foam producing unit 16 is fully installed and the liquid levels are equal and foam is produced by simply applying pressure to the surface of the liquid L in the inner container tending to lower the level in said container to the point indicated by L'. Release of pressure again causes liquid L to enter the inner container, such entry being assisted by the relative negative pressure inside the container 18 resulting from release of the bulb 32.

Essentially, the use of a valved inner container of a substantially smaller volume than that of the other container provides the advantage that a large container can produce foam effectively with the application of air pressure to a relatively small auxiliary container which requires less air to produce the necessary pressure to form the foam thereby permitting rapid foaming action with a relatively small air pressure actuating means. Good results have been obtained using an outer container and inner container having cross-sectional areas proportions of between fifty-to-one (50:1) and one hundred-to-one (100:1) based on an inner container diameter of one inch (1").

I claim as my invention:

1. A foam dispenser device, comprising:

(a) an outer container for holding foamable liquid having a discharge port, and (b) a foam producing unit mounted to the container and separating the area adjacent the discharge port and the interior of the container, said form producing unit including:

1. an inner container disposed within the outer container, and having an opening communicating with said outer container,
2. a closure for the inner container having pressurized air inlet means communicating with the inner container and foam outlet means,
3. foam producing means communicating with the foam outlet means, said foam-producing means including air-receiving means communicating with the air inlet means to receive pressurized air and liquid-receiving means including an inwardly extending conduit having an opening communicating with the interior of the inner container to receive liquid,
4. valve means for the inner container opening said valve means selectively closing said opening when air pressure within the inner container is increased, to supply foamable liquid from the inner container to the conduit of the foam producing means, said valve means selectively opening said opening when air pressure within the inner container is decreased to permit flow of foamable liquid from the outer container to the inner container, and (c) a pump means supplying pressurized air to the air inlet means, said pump means including an opening communicating with ambience and valve means selectively closing said opening when air pressure within the pump means is increased and selectively opening said opening when air pressure within the opening is decreased to admit air into said pump means.

2. A foam dispenser device as defined in claim 1, in which:

(d) the means in the foam producing means receiving air includes at least one opening disposed intermediate the conduit opening at the lower end of the inner container and the foam outlet means permitting air flow into said conduit.

3. A foam dispenser device as defined in claim 1, in which:

(d) the closure includes a cap having a passage extending therethrough providing the air inlet means, and (e) the inner container includes a tubular member integrally formed with the closure cap.

4. A foam dispenser device as defined in claim 3, in which:

(f) the integrally formed inner container tubular member and closure cap are received by the outer container discharge port.

* * * * *

UNITED STATES PATENT AND TRADEMARK OFFICE

CERTIFICATE OF CORRECTION

PATENT NO. : 4,531,660

DATED : July 30, 1985

INVENTOR(S) : George W. Ford, Jr.

It is certified that error appears in the above-identified patent and that said Letters Patent are hereby corrected as shown below:

Column 3, Line 7, delete "with" and insert --within--.

Column 3, Line 9, delete "beam" and insert --foam--.

Column 3, Line 52, delete "other" and insert --outer--.

Column 4, Line 9, delete "form" and insert --foam--.

Signed and Sealed this

*Fifteenth* Day of *October 1985*

[SEAL]

*Attest:*

*Attesting Officer*

DONALD J. QUIGG

*Commissioner of Patents and Trademarks—Designate*